United States Patent [19]

Anderson

[11] 4,037,833

[45] July 26, 1977

[54] RIDING TOY FOR CHILDREN

[76] Inventor: Paul R. Anderson, 23701 Surf Cove, Laguna Niquel, Calif. 92677

[21] Appl. No.: 683,408

[22] Filed: May 5, 1976

[51] Int. Cl.[2] ..... A63G 19/02

[52] U.S. Cl. ..... 272/52; 280/1.13

[58] Field of Search ..... 272/1 R, 1 B, 33 A, 272/52, 52.5, 53.1, 53.2, 114; 46/87, 88; D34/2 R, 2 A, 2 B, 2 C, 2 D, 15 B, 15 N, 15 DD, 15 AE; 280/1.13, 1.175, 1.188, 1.189, 1.208; 9/310 B, 310 G, 347, 348; 297/423

[56] References Cited

U.S. PATENT DOCUMENTS

| | | | |
|---|---|---|---|
| 1,712,703 | 5/1929 | Hudson | 272/33 A |
| 1,851,768 | 3/1932 | Hubbell | 272/1 B |
| 2,688,207 | 9/1954 | Hurt | 272/1 B X |
| 2,999,688 | 9/1961 | Gabrielson | 272/33 A |
| 3,902,737 | 9/1975 | Berger et al. | 297/423 X |
| D. 158,251 | 4/1950 | Couzens | D34/15 AE |
| D. 161,305 | 12/1950 | Bernstein | D34/15 DD |
| D. 222,091 | 9/1971 | McDermott et al. | D34/15 DD |
| D. 222,915 | 2/1972 | Alston | D34/15 AE |
| D. 223,675 | 5/1972 | Raphael | D34/15 DD |
| D. 224,601 | 8/1972 | Gone | D34/15 AE |

FOREIGN PATENT DOCUMENTS

| | | | |
|---|---|---|---|
| 252,089 | 1/1963 | Australia | 46/87 |
| 265,050 | 2/1927 | United Kingdom | 272/1 B |

OTHER PUBLICATIONS

"Water Pony," General Playground Equipment, Inc. catalog, No. 22, p. 43, Sept. 27, 1948.

*Primary Examiner*—Richard C. Pinkham
*Assistant Examiner*—Arnold W. Kramer
*Attorney, Agent, or Firm*—William I. Beach

[57] ABSTRACT

A riding type toy comprising an animal-like structure which has a generally ellipsoidal body, an upright neck and head portion. A pair of handhold bars extends from opposite sides of the head. The body has a lower surface and an upper surface for a child to sit on and grip the handhold bars so as to rock and rotate the lower surface of the body slidably on a ground surface. A bumper guard extends around the body between the lower and upper surface to limit rocking in any direction. On the upper surface of the body a shallow dish-like basin seat is formed with a pair of arcuate channels extending therefrom to act as leg supports for the rider. Replaceable coverings simulating different animals may be secured to the body by suitable fastenings.

7 Claims, 5 Drawing Figures

RIDING TOY FOR CHILDREN

BACKGROUND OF THE INVENTION

1. Field of the Invention

The present invention relates to riding toys and more particularly to a riding toy that can be rocked and rotated in slidable movement with a ground surface.

2. Description of the Prior Art

Traditionally, children have been drawn to and fascinated with animal type toys. When such a toy is constructed large enough children tend to climb on and ride them. Even in his play a child will straddle a stick or broom and gallup about as if astride a horse and image all sorts of exciting adventures.

Among simulated animal toys the hobbyhorse has long been a familiar object. The hobbyhorse or rocking horse as with other animal toys has progressed from the type mounted on arcuate rails to coiled springs, vibrating platforms, reciprocating vertical rods and the like. For the most part these devices rocked forward and backward and frequently were made to rotate. The translational motion, however, was more or less limited to a stationary base and the riding toy was restricted to a non-traveling motion.

Some attempts have been made to provide a riding toy which will rock and slide or travel on a ground surface. Such a device is shown in U.S. Pat. No. 3,380,735 issued to Gloria M. Rigby which provides a bowl-shaped article in which a child sits and may rock or turn through provision of handholds. A frusto-conical flange on the device extends outwardly and downwardly from the bowl-shaped body to act as a bumper to limit the rocking motion. It is suggested that a child seats himself in the device, grasps the top portion and can rock back and forth and can also cause the device to turn about while it is being rocked. As pictured, the child must necessarily be seated with his knees drawn up under his chin. In this cramped position it is obviously difficult to apply adequate impetus to the bowl-shaped body to cause it to rock forcefully enough to travel on a floor or ground surface. Ordinarily, having a spherical shaped bottom as shown, the bowl will tilt readily and strike the frusto-conical flange on the floor. The reaction of the flange in combination with the changing positional weight of the child will cause the bowl to rock and tilt it again in the opposite direction. Hence, the bowl will rock or spin in a stationary position.

Similar bowl-shaped devices are shown in the following references:

U.S. Pat. No. 3,141,669
U.S. Pat. No. 2,999,688
U.S. Pat. No. 2,988,358 wherein all have the same rocking characteristics, low center of gravity and correspondingly short tilting moment arm with very limiting translational movement in a traveling direction.

Therefore, it is the object of the present invention to provide an animal shaped riding toy which will rock and slide freely on a ground surface and therewith will travel about as long as the rocking motion is maintained.

SUMMARY OF THE INVENTION

In carrying out the principles of the present invention in accordance with a preferred embodiment thereof, a riding toy for children comprises a rocking structure simulating an animal form having a generally ellipsoidal shaped body portion including a bottom surface adapted to engage a ground surface. A neck portion extends upward from the upper surface adjacent the peripheral edge of the body and has a head portion at the distal end. A pair of handhold bars having one of each extending outward of the opposite sides of the head for a child to grip while seated on the top surface provides the means for rocking and rotating the body slidably on the ground surface. A bumper guard is provided around the body portion and spaced from the ground surface to prevent said body from overturning beyond a safe angle from the vertical. The bumper contacts the ground and provides a reactive force to return the body to an upright position.

DETAILED DESCRIPTION

Figure 1:
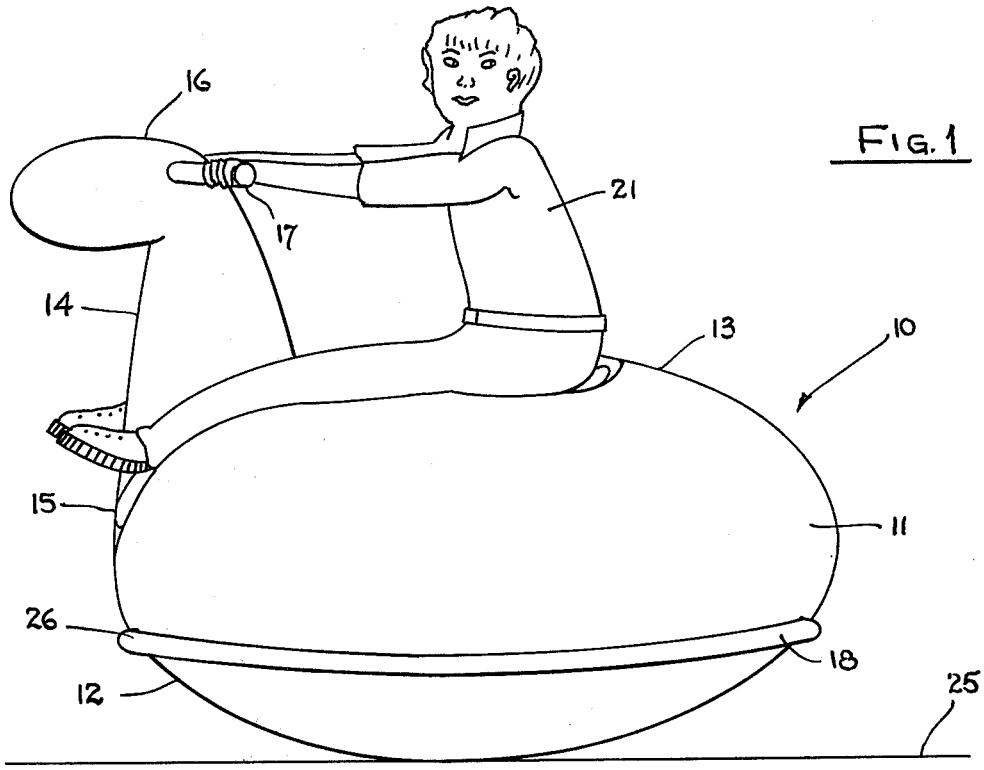
FIG. 1 is a perspective side view of a riding toy representing the present invention.
Figure 2:
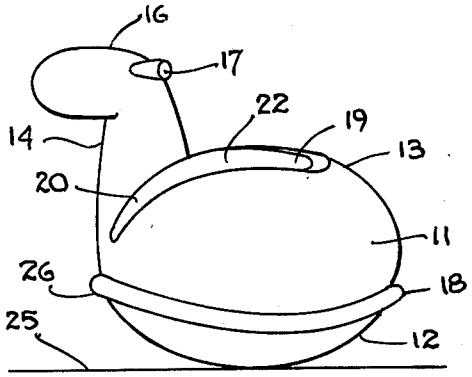
FIG. 2 is a perspective side view showing a portion of the seat and leg rest of the body in FIG. 1.
Figure 3:
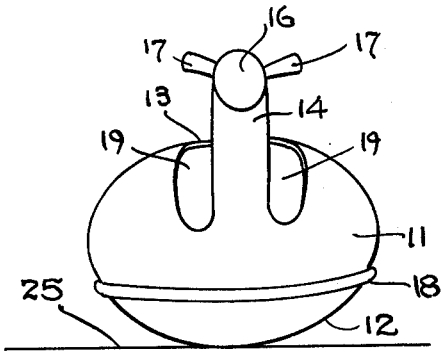
FIG. 3 is a front view of FIG. 2 showing a front view of the leg rest.

Referring to FIGS. 1, 2 and 3, it can be seen that the riding type toy 10 disclosed consists of body portion 11 having a bottom surface 12 and a top surface 13. An elongate neck portion 14 extends upward adjacent the peripheral edge 15 of the body portion 11. On the upper distal end of neck portion 14 is head portion 16. Extending from the opposite sides of head 16 is a pair of handhold bars 17. The body portion 11, neck portion 14, head portion 16 and handhold bars 17 represent the parts of a simulated animal form. Incorporated also on the animal form is a bumper guard 18 which extends around the girth of bottom surface 12.

In FIG. 2 there is shown a side perspective view of seat rest 19 together with leg rest 20 formed in surface 13. Seat 19 is essentially a shallow dishlike basin particularly suitable for child 21 in which to sit. Leg rest 20 comprises a pair of channel extending downwardly from opening 22 of seat rest 19 on opposite sides of neck portion 14 as seen in front view in FIG. 3. Leg rest 20 is adapted to support the legs of child 21.

Figure 4:
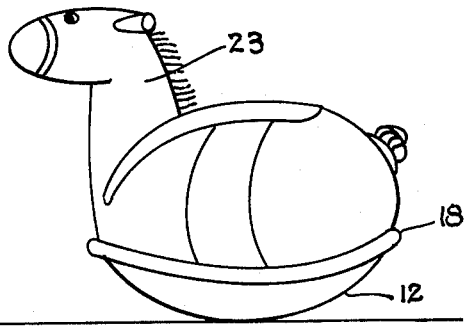
FIG. 4 is a perspective side view of a modified form of FIG. 3 showing the animal form with a covering thereon of a replica of a horse.
Figure 5:
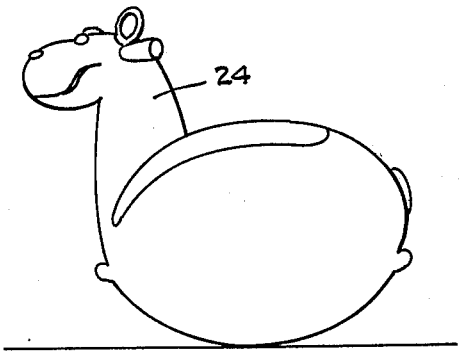
FIG. 5 is a perspective side view of an alternate covering of another replica of an animal.

A modified form of riding toy 10 is shown in FIG. 4 wherein the animal form is partially enclosed in covering 23 which simulates the general shape and characteristics of a horse. Covering 23 may be made of fabric, plastic or like material. Although covering 23 is arranged to cover riding toy 10 from head portion 16 down to bumper guard 18 as shown in FIG. 4 it may also be enlarged to completely enclose riding toy 10 such as covering 24 shown in FIG. 5 so as to resemble another animal as for example, a hippopotomus. Various fastening means can be employed to tie or secure covering 23 and 24 to the animal form. It is suggested that a drawstring and a zipper seam can be two likely means for fastening coverings 23 and 24 respectively to the aforementioned animal form.

In operating the present invention the child 21 seats himself in seat rest 19 with legs supported in leg rest 20 and leans forward to grip handhold bars 17. Using his body weight as leverage he can straighten his arms and push forward on handhold bars 17. With pressure applied therewith the body portion 11 will rock forwardly and bring head portion 16 downwardly in the direction of ground surface 25 until the front bumper guard portion 26 strikes ground surface 25. Should guard 18 strike ground surface 25 hard enough it will tend to urge the bottom surface 12 in a backward direction before body portion 11 is returned to an upright position. Likewise, to rock backwards will tend to urge the bottom surface 12 forward. Therefore, child 21 by virtue of rearing backward sufficiently to strike the bumper guard 18 just hard enough to return body portion 11 up to or barely past the vertical or upright position, will by repeating such rocking motion cause bottom surface 12 to creep in a forwardly direction. Thus, by this means the present invention can be made to travel from one end of a room to the other. Further, by pulling on one end and pushing on the other of handhold bars 17 child 21 may turn body portion 11 from side to side or in a circular path.

Accordingly, from the description and illustration of the present invention it is obvious that it provides many important advantages which can be used effectively as a riding toy for children.

The foregoing description is to be clearly understood to be given by way of illustration and example only, the spirit and scope of the present invention being limited solely by the appended claims.

I claim:

1. A riding type toy for children, which comprises:

a rocking structure simulating an animal form having a generally ellipsoidal shaped body portion including a bottom surface adapted to engage a ground surface, a top surface and a neck portion extending upwardly adjacent the peripheral edge of the body portion having a head portion at the distal end thereof, a pair of handhold bars having one of each extending outwardly of opposite sides of the head for a child to grip while seated on the top surface so as to provide the means for rocking and rotating said body slidably on the ground surface, bumper means extending around the body portion and spaced from the ground surface adapted to engage rocking contact with said ground surface when so rocked and prevent said body from overturning beyond a safe angle from the verticle, the bumper means being adapted to exert a reactive force to return said body to an upright position, a seat rest for the child to sit upon comprising a shallow dish-like basin disposed proximate the center of said top surface, and a leg rest comprising a pair of arcuate channels in said top surface extending from the seat rest downwardly on opposite sides of the neck portion for supporting the legs of said child.

2. A riding type toy recited in claim 1 wherein:

said ellipsoidal shaped body is an ellipsoid having a ratio of the minor diameter to the major diameter of 1 to 1.5.

3. A riding type toy recited in claim 2, wherein:

the bumper means comprises a hemispherical like bulge disposed in a plane normal to the minor diameter and approximately one-third of the distance from the major diameter to said ground surface.

4. A riding type toy recited din claim 3, wherein:

the safe angle beyond which it is not safe to rock is not less than 30° from the virtical.

5. A riding type toy recited in claim 4, wherein:

said animal form is constructed of plastics.

6. A riding type toy for children, which comprises:

a rocking structure simulating an animal form having an ellipsoidal shaped body portion including a bottom surface for contacting a ground surface, a top surface and a neck portion extending upwardly adjacent the peripheral edge of the body portion having a head portion at the distal end thereof, a pair of handhold bars having one of each extending outwardly of opposite sides of the head for a child to grip while seated on the top surface so as to provide the means for rocking and rotating said body slidably on the ground surface, bumper means extending around the body portion and spaced from the ground surface adapted to engage rocking contact with said ground surface when so rocked and prevent said body from overturning beyond a safe angle from the verticle, the bumper being adapted to exert a reactive force to return said body to an upright position, a seat rest for the child to sit upon comprising a shallow dish-like basin disposed proximate the center of the top surface, and a leg rest comprising a pair of arcuate channels in said top surface extending from the seat rest downwardly on opposite sides of the neck portion for supporting the legs of said child, and an exterior replaceable covering representing the simulation of an animal such as a horse adapted to enclose the body.

7. A riding type toy recited in claim 6, wherein:

the replaceable covering is secured to said body by fastening means.

* * * * *